United States Patent [19]

Riviere et al.

[11] Patent Number: 4,871,988

[45] Date of Patent: Oct. 3, 1989

[54] MICROWAVE TRANSMISSION LINE OF THE SYMMETRICAL TYPE AND WITH TWO COPLANAR CONDUCTORS

[76] Inventors: Luc Riviere, 37, avenue du Chateau, 92190 Meudon; Alain Carenco, 4 rue Paul-Henry Thilloy, 92340 Bourglareine, both of France

[21] Appl. No.: 205,930

[22] Filed: Jun. 13, 1988

[30] Foreign Application Priority Data

Jun. 22, 1987 [FR] France ..... 87 08729

[51] Int. Cl.[4] ..... H01P 3/08

[52] U.S. Cl. ..... 333/238; 333/222

[58] Field of Search ..... 333/116, 26, 161, 204, 333/238, 246, 222

[56] References Cited

U.S. PATENT DOCUMENTS 3,573,674 4/1971 Wehner ..... 333/110 X 3,846,721 11/1974 Fritz et al. ..... 333/238 X 4,591,812 5/1986 Stegens et al. ..... 333/246 X

*Primary Examiner*—Paul Gensler

*Attorney, Agent, or Firm*—Laubscher, Presta & Laubscher

[57] ABSTRACT

This invention relates to an increase in the low longitudinal resonance frequencies of microwave transmission lines known as symmetrical lines, comprising two coplanar and parallel narrow conductive strips. According to the invention, the line further comprises a longitudinal and wide planar conductive strip which is parallel to one of the narrow strips at a sufficient distance not to substantially disturb the characteristic impedance of the initial symmetrical line and which is connected to the narrow strip by small planar end conductors thereby forming a longitudinal flat cavity. The cavity offers a first resonance frequency much greater than those of the initial symmetrical line and consequently affords a higher useful frequency bank of signals to be transmitted. The end conductors allow the line to be connected to coaxial connectors. In other embodiments, the cavity is divided into several resonant sub-cavities in order to raise the pass-band.

9 Claims, 2 Drawing Sheets

MICROWAVE TRANSMISSION LINE OF THE SYMMETRICAL TYPE AND WITH TWO COPLANAR CONDUCTORS

BACKGROUND OF THE INVENTION

1. Field of the Invention

This invention relates to improvements to microwave transmission lines comprising two flat parallel and coplanar conductive strips.

2. Description of the Prior Art

Such normally used transmission lines are divided into two types, those referred as to symmetrical lines and those referred to as asymmetrical lines. A symmetrical line consists of two linear metal strips having equal widths W and arranged parallel to one another at a predetermined distance G on a non-conductive substrate. An asymmetrical line consists of a first conductor in the form of a narrow flat metal strip having a small width W and a second conductor in the form of a wide longitudinal conductive area or strip having a width l much greater than W and placed parallel to the narrow conductive strip at a distance G therefrom on the same type of substrate.

For a given characteristic line impedance, the symmetrical line requires a ratio W/G, width of strip over width of interstice between conductors, greater than that of the asymmetrical line. The result of this is that the symmetrical line has wider strips than that of the asymmetrical line and/or a narrower interstice than that of the asymmetrical line. This dimensional feature of the asymmetrical line is advantageous in that it makes use of less resistant conductive strips while reducing line width. The symmetrical line is often chosen when it is necessary to provide symmetry of the electric and/or magnetic fields of the microwave that is propagated in the line.

However, two major drawbacks inherent in the connection of the line and in the resonances of the line are to be considered when a symmetrical line is used.

In general, the use of the symmetrical line requires connections between ends of the line and exterior microwave components such as a microwave source, load, or probe, by means of miniature or subminiature coaxial connectors. As already known, such a coaxial connector comprises an elongate central internal conductor having a small diameter and a cylindrical external conductor having a greater diameter and, consequently, offers an asymmetrical conductive structure. The differences in geometric shapes of the connector and the symmetrical line also give rise to difficulties with connection. In practice, these difficulties are resolved by providing, at the end of the line to be connected, a small substantially rectangular flat end conductor connected coplanarly to the end of the one of the linear strips and forming with the end of the other strip a portion of a flat asymmetrical line. The end conductive plane is laterally welded to the external cylindrical conductor of the coaxial connector, and the projecting end of the internal conductor of the connector is welded to the end of the other strip of the line.

The second drawback of the symmetrical line consists in the appearance of relatively low spurious freuqencies of longitudinal resonance which limit the useful frequency band of the symmetrical line. The longitudinal resonances are by definition lower than transverse resonances that are within the very high frequency range. Experimental analysis of resonance shows that some of the microwave energy is neither transmitted nor reflected, but is radiated. In fact, a symmetrical line has natural frequencies for which a stationary wave may be formed, thus setting up a source of radiation.

OBJECT OF THE INVENTION

The main object of this invention is to provide a microwave transmission line of the symmetrical line type having two parallel and coplanar narrow strips, offering the advantages of symmetrical lines in accordance with the above prior art, without the drawbacks of the latter, in particular as regards the limitations due to resonance frequencies. In other words, a line embodying the invention offers a useful frequency band much higher than a symmetrical line according to the prior art, for identical dimensions in relation to the conductive strips.

SUMMARY OF THE INVENTION

Accordingly, a microwave transmission line of the symmetrical type according to the invention includes a first conductor in the form of a first flat narrow conductive strip extending over the entire length of the line and a second flat conductor coplanar with the first conductor. The second conductor includes a second flat narrow conductive strip extending parallel to the first narrow strip, first and second planar end conductors substantially rectangular and flat, connected to the ends of the second narrow strip and having sides substantially parallel to the ends of the first narrow strip, respectively, and a longitudinal wide planar conductive strip extending coplanar and parallel to the first and second narrow strips over the entire length of the line.

The wide conductive strip has ends connected to the first and second planar end conductors, respectively, thereby forming in the second flat conductor a resonant cavity bounded by the longitudinal sides of the second narrow strip and having wide strip and by transverse opposite sides of the planar end conductors.

The constitution of the resonant cavity by the presence of the longitudinal wide conductive strip connecting the ends of the second narrow strip through the small planar end conductors provides longitudinal resonance frequencies much greater than those provided by a symmetrical line having only two narrow conductive strips. Indeed, the appearance of stationary waves at low resonance frequencies of the symmetrical line having only two strips is prevented when the dimensions of the cavity are correctly chosen.

In particular, the distance between the longitudinal wide strip and the second narrow strip defining the width of the cavity is selected to be relatively large in relation to the geometrical features of the line made up of two narrow strips, i.e., the widths of the narrow strips and the width of the interstice between these two strips. Under these conditions, the prsence of the longitudinal wide conductive strip only disturbs the characteristic impedance of the symmetrical line to a negligible extent.

If it is desired to raise the first cutout freuquency of the transmission line, the cavity is then divided into one or several sub-cavities by intermediate conductive strips connected transversely to the seocnd narrow strip and the longitudinal wide strip.

Furthermore, the short circuits achieved by the planar end conductors between the second narrow strip and the longitudinal plane make it possible, with the ends of the first strip, to make two asymmetrical line end sections for easier connection of the transmission line to coaxial connectors.

DESCRIPTION OF THE DRAWING

The foregoing and other objects, features and advantages of the invention will be apparent from the following detailed description of several preferred embodiments of the invention with reference to the corresponding acocmpanying drawings in which.

DESCRIPTION OF THE PREFERRED EMBODIMENTS

Figure 2:
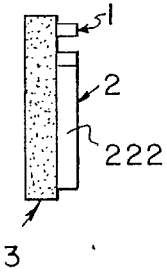
FIG. 2 is a side view of the line shown in FIG. 1.
Figure 1:
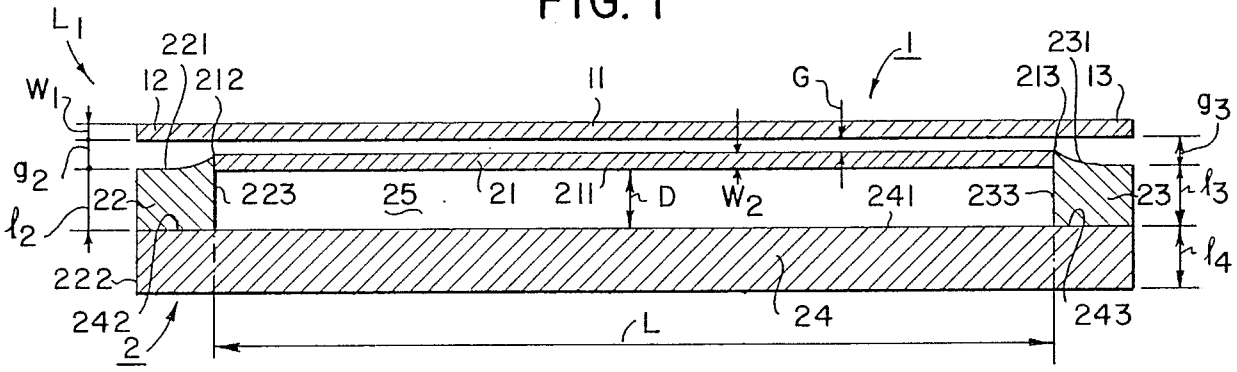
FIG. 1 is a top view of a microwave transmission line having a long resonant cavity.

Referring to FIGS. 1 and 2, a microwave transmission line comprises a first flat conductor 1 and a second flat conductor 2 which are fixed in coplanar fashion on a board made of a non-conductive material 3 such as a dielectric substrate. Conductors 1 and 2 are for example conductive strips screen printed onto board 3 and having the same thickness.

The first conductor 1 consists solely of a linear narrow strip 11 having a uniform width $W_1$.

The second conductor 2 consists of a linear narrow strip 21 that has a width $W_2$ and that is parallel to the first narrow strip 11, two rectangular transverse and end planes 22 and 23, and a longitudinal rectangular plane or wide strip 24 parallel to narrow strips 11 and 21. The four components 21 to 24 making up conductor 2 are bounded by hatching in FIG. 1 in order to differentiate them, although they form an integral conductor.

Strip 21 thus extends parallel to strip 11 over the major part L of the length of the microwave line, in order to form a symmetrical line when widths $W_1$ and $W_2$ are equal or substantially equal. The distance G between the two strips 11 and 21 is of the same order of magnitude as the widths $W_1$ and $W_2$ and, generally speaking, lower than the widths.

The end planes 22 and 23 have small sides 221 and 231 substantially parallel to the ends 12 and 13 of the first strip 11 and separated therefrom by interstices with widths $g_2$ and $g_3$ greater than width G, so that transitions between strip 21 and planes 22 and 23 offer offsets 212 and 213. Widths $l_2$ and $l_3$ of end planes 22 and 23 are much greater than widths $W_1$ and $W_2$ of strips 11 and 12, in order to form asymmetrical line portions at the ends of the microwave line. These two portions are used to connect the symmetrical line 11+21 to connectors for connection to coaxial lines. In particular, pairs with dimensions $g_2$ and $l_2$, and $g_3$ and $l_3$ which may be different, are matched as a function of characteristic impedances and therefore of the dimensions of the coaxial lines to be connected respectively.

Figure 3:
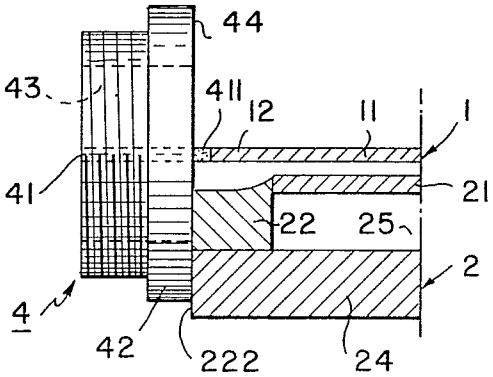
FIG. 3 is a top view of one end of the line shown in FIG. 1 connected to a coaxial connector.
Figure 4:
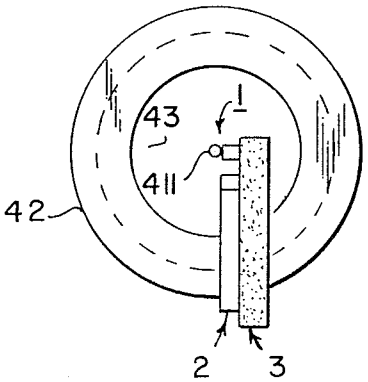
FIG. 4 is a side view of the line end and the coaxial connector.

As shown in FIGS. 3 and 4, such a connector 4 to be connected at the end of the line including plane 22, conventionally comprises a central metal conductor 41, an external cylindrical conductor 42 referenced to the ground, and an insulating material 43 filling the interior of conductor 42 around internal conductor 41. An end 411 of internal conductor 41 projects from one base side 44 of connector 4 and is soldered in colinear fashion to the corresponding end 12 of the first strip 11. An edge 222 of end plane 22 perpendicular to strip 11 is applied against the face of connector 44 and is welded to external conductor 42 in order to be grounded.

Strips 11 and 21 and end conductor planes 22 and 23, without conductor plane 24, together make up a known microwave line of the symmetrical coplanar strip type (11 and 21) and with asymmetrical end (12 and 22; 13 and 23).

According to the invention, the microwave line also comprises longitudinal and wide rectangular conductor plane 24 having a predetermined width $l_4$. Plane 24 has a long side 241 which is parallel to and facing a longitudinal side 211 of the second narrow strip 21 and which presents ends 242 and 243 constituting second short longitudinal sides of end conductor planes 22 and 23. Thus, in ground conductor 2 appears a rectangular flat cavity 25 the long sides of which are the facing sides 211 and 241 of strip 21 and longitudinal plane 24 and the short sides of which are facing long sides 223 and 233 of end planes 22 and 23.

The length of cavity 25 is equal to L, i.e., substantially less than that of the microwave line. Length L for a predetermined width D of the cavity defines a longitudinal resonance frequency of the cavity which inhibits any lower stationary wave frequency due to resonance of initial symmetrical line 11+21. Cavity 25 thus acts as a genuine low pass filter, the cutout frequency of which is equal to the lowest resonance frequency of the cavity.

Figure 5:
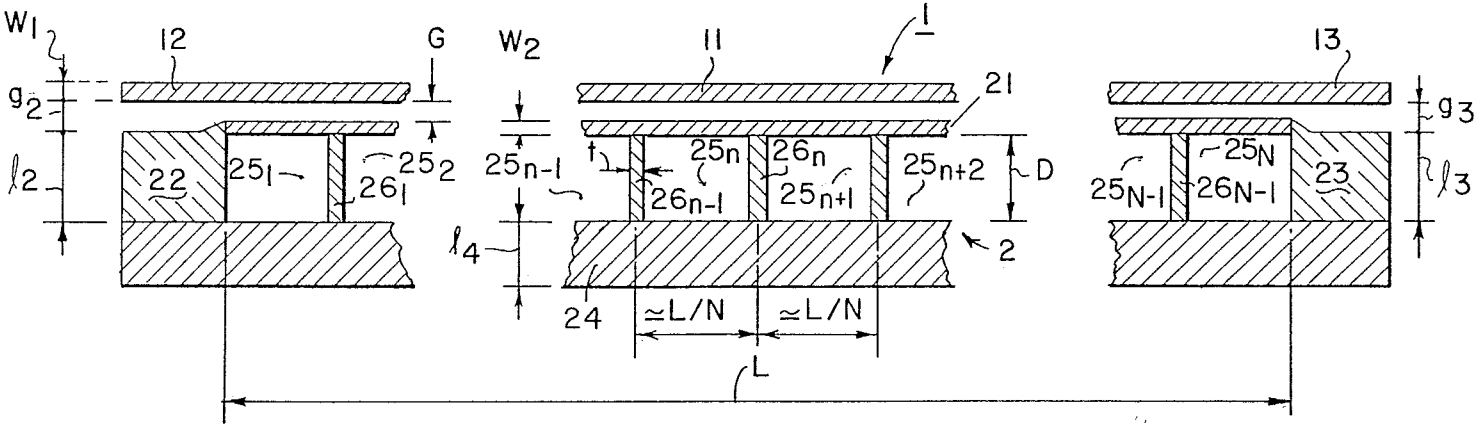
FIG. 5 is a top view of a second microwave transmission line having several resonant sub-cavities.

As shown in FIG. 5, if it is desired to increase the cutout freuqency in order to eliminate other longitudinal resonance frequencies of the symmetrical line, the length L of the cavity is subdivided into N identical sub-cavities $25_1$ to $25_N$ each having a length substantially equal to L/N. Between adjacent sub-cavities, for example $25_n$ and $25_{N+1}$, where n is an index lying from 1 to N, an intermediate narrow "wall" is provided constituted by a transverse short conductive strip $26_n$ that is perpendicular to longitudinal narrow strip 21 and longitudinal planar strip 24 and connected thereto. The N−1 transverse strips $26_1$ to $26_{N-1}$ with length D are thin and have a width t equal to or less than those $W_1$ and $W_2$ of strips 11 and 12. Each transverse strip plays a similar role to a shunt inductance between conductors 21 and 24.

The number N and dimensions, length L/N and width D, of sub-cavities $25_1$ to $25_N$ are chosen so as to ensure optimum filtering of low resonance frequencies, i.e., spurious longitudinal resonances of the symmetrical line. In practice, for a predetermined width D and a predetermined length L, it is possible to select the integral number N so that the lowest frequency of each of the sub-cavities is greater than the maximum frequency in the useful band of signals to be transmitted.

However, according to other embodiments, the lengths of the sub-cavities are different, or more generally the dimensions of the sub-cavities are different in order to select resonance frequencies and therefore determined cutout frequencies. For example, only with one wall $26_1$ and two sub-cavities $25_1$ and $25_2$ having slightly different lengths, the microwave line behaves as a low pass filter having a cutout frequency equal to the lower of the two resonance frequencies of the two sub-cavities $25_1$ and $25_2$ that are associated with the longer cavity.

Figure 6:
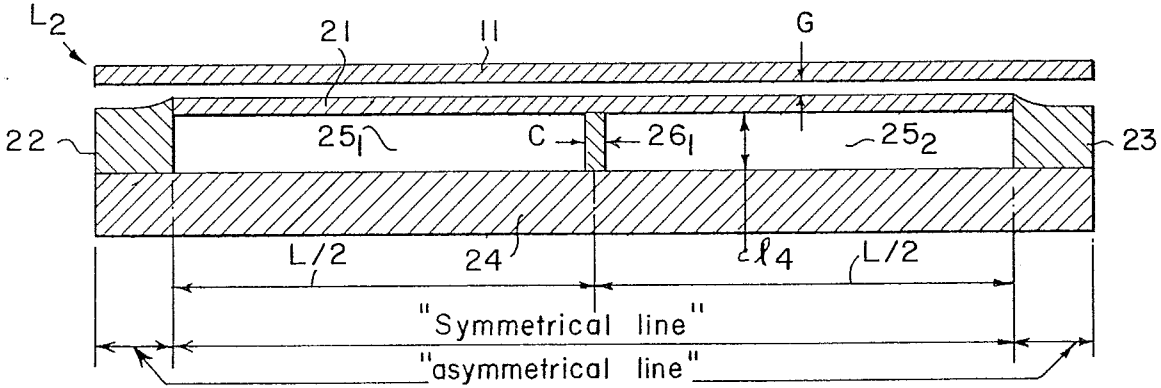
FIG. 6 is a top view of a third microwave transmission line having two resonant sub-cavities and dimensions of conductive planar strips identical to those of the line shown in FIG. 1.

By way of practical example, below are given the results of comparative measurements between a symmetrical line 11+21+22+23 of a known type on the one hand, and two lines according to the invention comprising members 11, 21, 22 and 23 identical to those of the symmetrical line and a longitudinal ground conductor plane 24. One, $L_1$, of the two lines according to the invention comprises only one large cavity 25 as shown in FIG. 1, while the second line $L_2$ according to the invention comprises one thin intermediate strip $26_1$ separating cavity 25 into N=2 identical sub-cavities $25_1$ and $25_2$, as shown in FIG. 6. The used dielectric material 3 was lithium niobate $LiNbO_3$. The characteristic impedance of the symmetrical line is 50 Ohms. The dimensions were as follows: L=14 mm, $W_1=W_2=80$ μm, G=50 μm, $g_2=g_3=135$ μm; $D \approx l_2=l_3=1$ mm; t=30 μm; and $l_4=1$ mm. The measurements were made in the frequency band between 10 MHz and 6 GHz.

For the symmetrical line 11+21+22+23 according to the prior art, and without ground plane 24, the first longitudinal resonance appears around 1 GHz. For line $L_1$ according to the invention, the first longitudinal resonance only appears at 2.5 GHz. The first longitudinal resonance of line $L_2$ with two sub-cavities is two times greater and is equal to around 5 GHz.

What we claim is:

1. A microwave transmission line of the symmetrical type having first and second asymmetrical ports, comprising (a) a dielectric substrate having a major face;

(b) a first conductor comprising a first flat narrow conductive strip supported by said substrate major face and extending between first and second ends over the entire length of said line;

(c) a second flat conductor supported by said major face of said substrate and being arranged coplanar with said first conductor, said second conductor comprising:

(1) a second flat narrow conductive strip extending parallel to said first narrow strip between said first and second ends of said first narrow strip;

(2) first and second planar end conductors forming with said first and second ends of said first narrow conductive strip the first and second line ports, said planar end conductors being substantially rectangular and connected with the ends of said second narrow strip, respectively, said planar end conductors further having sides substantially parallel to said first and second ends of said first narrow strip, respectively; and (3) a longitudinal wide planar conductive strip extending coplanar with and parallel to said first and second narrow strips over the entire length of said line, said second narrow strip being located between said first narrow strip and said wide planar strip, said wide planar strip having ends connected with said first and second end conductors, respectively, thereby forming in said second conductor a resonant cavity coplanar with said first and second conductors and bounded by longitudinal sides of said second narrow strip and said wide strip and by transverse opposite sides of said planar end conductors.

2. The microwave transmission line as defined in claim 1, wherein said second flat conductor comprises an intermediate conductive strip connected transversely with said second strip and said wide strip to divide said cavity into two resonant sub-cavities.

3. The microwave transmission line as defined in claim 1, wherein said second flat conductor comprises several intermediate conductive strips connected transversely with said second narrow strip and said wide strip in order to divide said cavity into several resonant sub-cavities.

4. The microwave transmission line as defined in claim 1, wherein a lowest longitudinal resonance frequency of said cavity is greater than a useful frequency band of signals to be transmitted by said line.

5. The microwave transmission line as defined in claim 3, wherein a lowest longitudinal resonance frequency of said sub-cavities is greater than the useful frequency band of signals to be transmitted by said line.

6. The microwave transmission line as defined in claim 3, wherein said sub-cavities are identical.

7. The microwave transmission line as defined in claim 3, wherein said intermediate conductors have a width smaller than the widths of said first and second strips.

8. The microwave transmission line as defined in claim 1, wherein said wide strip and said cavity have widths which are substantially equal.

9. The microwave transmission line as defined in claim 1, wherein the width of a longitudinal interstice extending between said first and second narrow strips and the widths of said first and second narrow strips are much smaller than the width of said cavity.

* * * * *